US006257938B1

(12) United States Patent
Day et al.

(10) Patent No.: US 6,257,938 B1
(45) Date of Patent: Jul. 10, 2001

(54) DATABUS MULTIPLEXING CONNECTION SYSTEM

(75) Inventors: Chia P. Day, Solon; William E. Cross, Brookfield; John S. Norris, Jr., Hubbard; Frank J. Spano, Jr.; Terry L. Basinger, both of Warren, all of OH (US)

(73) Assignee: Stoneridge, Inc., Warren, OH (US)

( * ) Notice: Subject to any disclaimer, the term of this patent is extended or adjusted under 35 U.S.C. 154(b) by 0 days.

(21) Appl. No.: 09/437,367

(22) Filed: Nov. 10, 1999

Related U.S. Application Data

(60) Provisional application No. 60/112,495, filed on Dec. 16, 1998.

(51) Int. Cl.[7] ..... H01R 11/09
(52) U.S. Cl. ..... 439/723; 439/721
(58) Field of Search ..... 439/723, 189, 439/721, 724, 283, 654, 620

(56) References Cited

U.S. PATENT DOCUMENTS

| | | | | |
|---|---|---|---|---|
| 3,471,822 | * | 10/1969 | Van Baelen | 439/53 |
| 3,508,189 | * | 4/1970 | Culver | 439/712 |
| 3,560,910 | * | 2/1971 | Sosinski | 739/712 |
| 3,611,255 | | 10/1971 | Shroyer | 339/60 R |
| 3,794,954 | | 2/1974 | Reimer | 339/19 |
| 3,824,524 | | 7/1974 | Glover | 339/60 R |
| 4,713,021 | | 12/1987 | Kobler | 439/272 |
| 4,784,619 | * | 11/1988 | Blanchet | 439/724 |
| 4,789,343 | | 12/1988 | Dougherty et al. | 439/34 |
| 4,842,525 | | 6/1989 | Galloway et al. | 439/34 |
| 4,854,898 | * | 8/1989 | Turk | 439/723 |
| 4,869,679 | | 9/1989 | Szegda | 439/272 |
| 4,940,420 | | 7/1990 | Munie | 439/272 |
| 4,956,561 | | 9/1990 | Tamer | 307/10.1 |
| 5,021,923 | * | 6/1991 | Zinn | 361/380 |
| 5,052,951 | * | 10/1991 | Johnson | 439/723 |
| 5,073,124 | | 12/1991 | Powell | 439/197 |
| 5,078,622 | | 1/1992 | Hunt, III et al. | 439/589 |
| 5,197,890 | | 3/1993 | Seymour | 439/77 |
| 5,283,712 | | 2/1994 | Michihira et al. | 361/785 |
| 5,316,507 | * | 5/1994 | Capp | 439/886 |
| 5,322,445 | * | 6/1994 | Ozaki et al. | 439/212 |
| 5,336,101 | | 8/1994 | Kasugai et al. | 439/272 |
| 5,353,190 | | 10/1994 | Nakayama et al. | 361/647 |
| 5,389,005 | | 2/1995 | Kodama | 439/272 |
| 5,397,254 | * | 3/1995 | Powell | 439/885 |
| 5,428,535 | | 6/1995 | Katsumata et al. | 364/424.05 |
| 5,446,626 | | 8/1995 | Dittmann et al. | 361/785 |
| 5,490,785 | * | 2/1996 | Hein et al. | 439/76.1 |
| 5,769,650 | * | 6/1998 | Aoyama et al. | 439/189 |
| 5,793,615 | | 8/1998 | Bach et al. | 361/752 |
| 6,010,366 | * | 1/2000 | Tanigawa et al. | 439/620 |

* cited by examiner

*Primary Examiner*—Gary F. Paumen
*Assistant Examiner*—Ross Gushi
(74) *Attorney, Agent, or Firm*—Arter & Hadden LLP

(57) ABSTRACT

A databus multiplexing connection system is disclosed including an electrical connector for multiplexing data including in-line CAN-bus splice connector. The connector includes a 4-way connector body and a secondary lock/bussing assembly. The secondary lock/bussing assembly includes a main body, buss-bars, and one or more optional resistors. The secondary lock/bussing assembly secures terminals inside the connector body, provides an interface for connection of a 2-way mating connector thereto, verifies that the terminals are properly installed (i.e. proper orientation) in the connector body.

16 Claims, 6 Drawing Sheets

DATABUS MULTIPLEXING CONNECTION SYSTEM

RELATED APPLICATIONS

The present application claims the benefit of U.S. Provisional Application No. 60/112,495, filed Dec. 16, 1998.

FIELD OF THE INVENTION

The present invention generally relates to an electrical connector and more particularly to an electrical connector for multiplexing data.

BACKGROUND OF THE INVENTION

Multiplexing of data is used in an increasing number of commercial trucks, agricultural vehicles, off-road equipment and marine applications. Controller Area Network buses known as "CAN-buses" (such as SAE J-1939) are being adopted in many future commercial vehicle programs and in industrial applications (such as DeviceNet.) A detailed description of multiplexing can be found in the SAE (Society of Automotive Engineers) Technical Series paper entitled "Practical Perspectives on Physical Layers for Truck Multiplexing," which is fully incorporated herein by reference.

The CAN-bus physically is a cable, as shown FIG. 1. It was first developed by Bosch and used in Mercedes-Benz S-series cars. Many semiconductor makers (including Intel, Motorola, Siemens, Philips, NEC, national Semiconductor) have produced CAN chips and microprocessors with CAN functions. The cable for the CAN-bus contains two signal wires and a drain wire. The signal wires are termed CAN-H and CAN-L. The drain wire is termed CAN-SHLD. The drain wire allows easy termination of the shield to drain away stray current caused by electromagnetic radiation.

There are two ways to make connections from the CAN-bus to ECUs (Electronic Control Units). One way is shown on the right side, below ECU n+1 in FIG. 1, wherein several connectors are used. The connector labeled A-B-B is a T-connector. The other connectors are mating connectors labeled B-mate and A-mate. A T-connection method is one way for a stub (i.e. branch) to be connected to the CAN network. The T-connection system includes a T-connector and three mating connectors. When needed, a heat shrinkable tube is used to seal the ends of the connectors from the external environment.

One alternative to the T-connection system employs ultrasonic welders to respectively weld CAN-H, CAN-L and CAN-SHLD wires. Ultra-sonic welding is a type of friction welding that joins the copper wires by vibrating them in shear while clamping the wires together. The vibration causes the copper molecules to mingle and diffuse, forming a true metallurgical bond. Only un-tinned wires are used in this process. The welded CAN-H, CAN-L and CAN-SHLD splices are separated with insulators. A covering, including a foil shield and protective vinyl tape, is then applied over the entire splice assembly. The splice assembly is then covered with shrinkable tubing to protect against environmental factors. The finished package is small and allows easy routing through tight spaces. The splices are protected from moisture and other contaminants. A splice connection (SC) and a T-connector (TC) are illustrated in FIG. 2.

In SAE J-1939, which is a recommended practice of the Society of Automotive Engineers (SAE), a T-connector is recommended as a method to connect a device to the CAN-network using a jacketed cable of a twisted pair, a drain wire and continuous conductive foil. However, the T-connector is expensive to manufacture. The splicing method was also adopted as a recommended practice to commercial trucks, with a lower overall cost than the T-connector. However, there remains some difficulties in processing splices. Accordingly, the cable jacket has been modified to make it easier to strip, and the wire has been modified to be non-tinned to allow use of ultrasonic welding. Moreover, several heat-shrink methods are being investigated for potential cost reductions and quality improvement.

There is another recommended practice, i.e. J1939-15 or "Lite." The "Lite" cable consists of the jacketed unshielded twisted pair only. There is no drain wire and shield. This opens up possibilities of using new connectors for the "lite."

The present invention is directed to a device and method for a reliable, inexpensive, easy-to-assemble, serviceable, compact databus multiplexing connection system for connecting electronic control units (ECUs) to a databus, such as the CAN-bus.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

SUMMARY OF THE INVENTION

According to the present invention there is provided a databus multiplexing connection system.

An advantage of the present invention is the provision of a databus multiplexing connection system which includes an in-line CAN-bus splice connector.

Still another advantage of the present invention is the provision of a databus multiplexing connection system which is quick and easy to install to a network.

Still another advantage of the present invention is the provision of a databus multiplexing connection system which provides improvements in reliability.

Still another advantage of the present invention is the provision of a databus multiplexing connection system which can be conveniently serviced in the field.

Still another advantage of the present invention is the provision of a databus multiplexing connection system which provides a greater number of installation alternatives.

Yet another advantage of the present invention is the provision of a databus multiplexing connection system which provides a simpler and less costly means for termination on a network bus.

Yet another advantage of the present invention is the provision of a databus multiplexing connection system which provides a simpler and less costly means for termination on a network bus.

Yet another advantage of the present invention is the provision of a databus multiplexing connection system which is inexpensive to manufacture.

Yet another advantage of the present invention is the provision of a databus multiplexing connection system which includes a connector complying with the J-1939-15 specification.

Detailed Description of the Invention

Figure 3A:
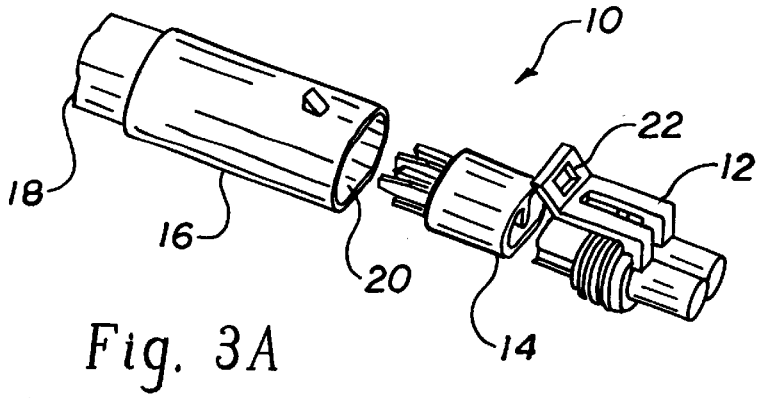
FIGS. 3A, 3B and 3C are respective exploded, assembly and side-sectional views depicting the present connector in engagement with a 2-way plug connector.
Figure 3B:
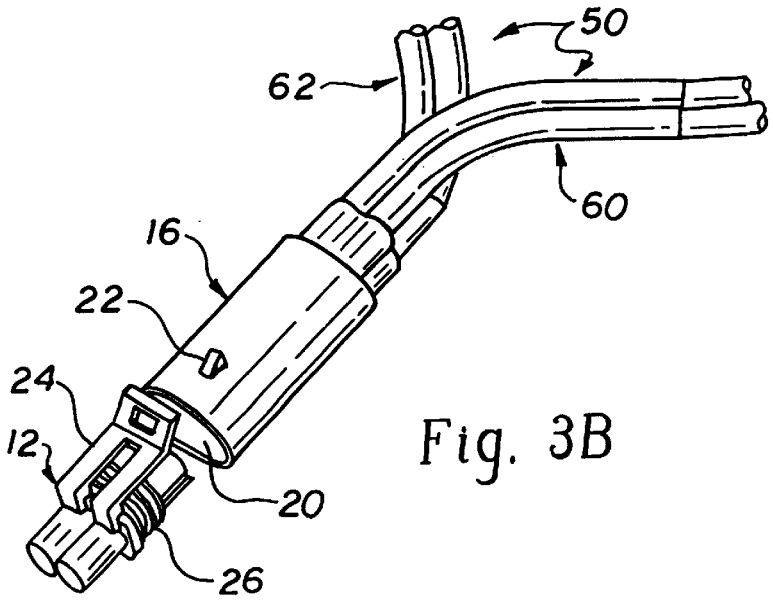
Figure 3C:
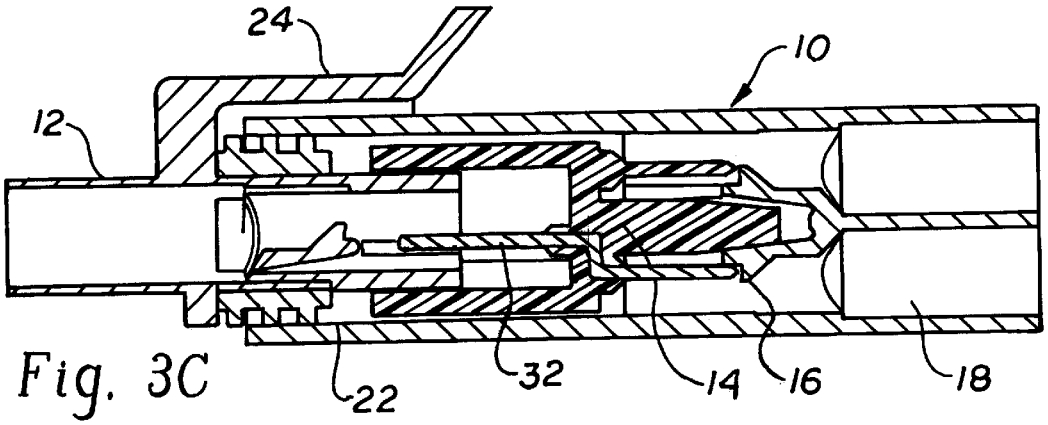

The drawings are now referred to for purposes of illustrating a preferred embodiment of the invention and not for purposes of limiting the same. The present connector assembly, as generally shown in FIGS. 3A, 3B and 3C, includes a connector member 10 which is connectable to a plug connector 12 having at least one signal input, preferably two, so as to correspond to CAN-H and CAN-L signal pathways. A secondary lock/bussing assembly 14 is received within the connector member 10. The bussing assembly 14 is electronically engagable with the plug connector 12, and splices at least one signal input into a respective plurality of signal outputs, as will be more particularly described below. Preferably, the plurality of signal outputs is four, so as to produce two sets of CAN-H and CAN-L outputs. In this way, the present invention has special utility as a T-connector in a multiplexed data-carrying system, for connecting the signals to an electronic control unit and a data bus. However, it should be understood that the present invention is not limited to such applications, and the configuration and number of signal inputs and spliced outputs can be varied while remaining within the scope of the invention.

Figure 4A:
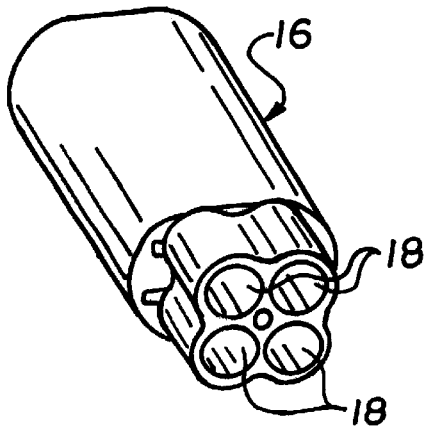
FIGS. 4A and 4B are respective reverse and frontal views of the present connector body.
Figure 4B:
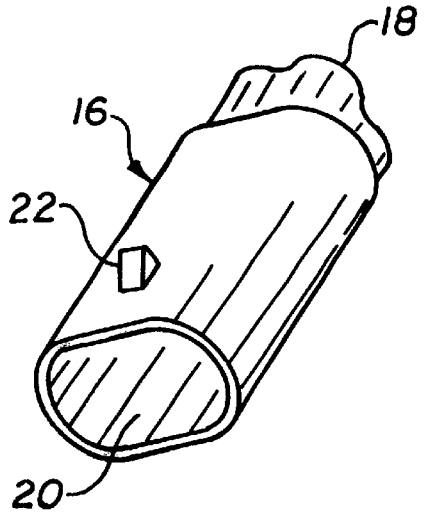
Figure 5:
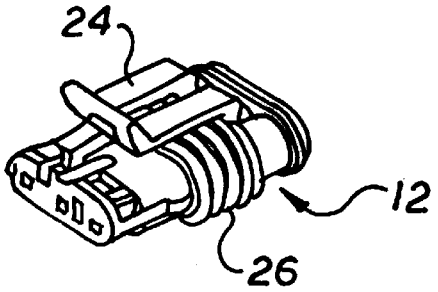
FIG. 5 is an oblique view showing a plug connector of a type that can be used with the invention.
Figure 6A:
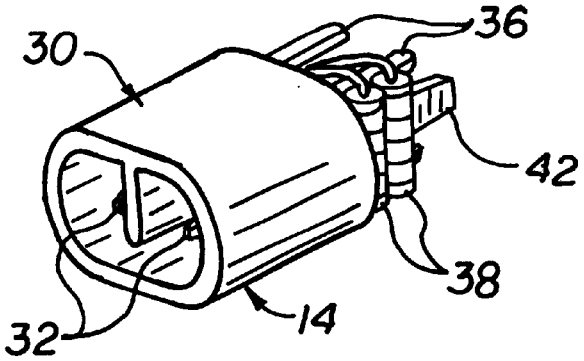
FIGS. 6A, 6B, 6C and 6D are respective three-quarter, side, frontal and reverse views of the present secondary lock/bussing assembly.
Figure 6B:
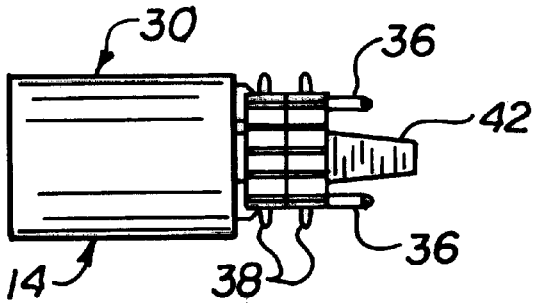
Figure 6C:
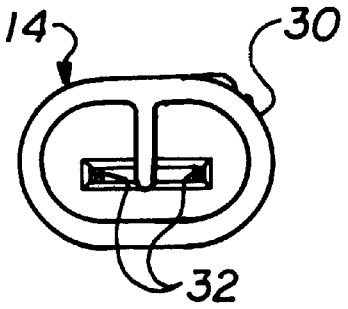
Figure 6D:
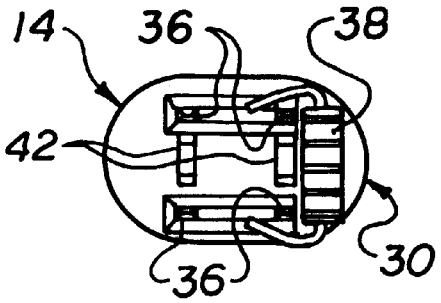

The connector member 10 includes a primary lock/connector body 16 for receiving and retaining the buss assembly 14. As is shown particularly in FIGS. 4A and 4B, the connector body 16 is a 4-way connector body, to accommodate the two sets of CAN-H and CAN-L outputs. The connector body 16 is preferably formed of plastic, and includes an end having four barrels 18 for holding four individual wire assemblies for carrying the respective signals. The preferred connected body 16 includes an open end 20 for receiving the plug connector 12. The connector body 16 includes one or more mechanical locking features 22 that mechanically engage with a respective locking feature on the plug connector 24, as especially shown in FIG. 5. These locking features 22, 24 securely hold together the connector member 10 and the plug connector 12 when these components are connected, as shown in FIG. 3C. As shown in FIG. 5, the plug connector 12 is preferably a Superseal 1.5 series 2-way plug connector, sold by AMP Incorporated of Harrisburg, Pa. This type of plug connector includes a seal 26 made of silicon rubber that provides a secure, watertight seal in the open end 20 of the connector body 16.

Figure 8:
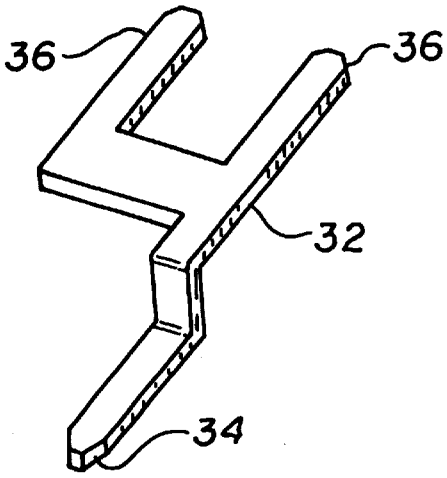
FIG. 8 shows a buss-bar as used with the present bussing assembly.

As particularly shown in FIGS. 6A–6D, the present bussing assembly 16 is preferably a 4-way secondary lock/bussing assembly to splice the input CAN-H and CAN-L signals into two sets. The bussing assembly 14 includes a main body section 30, preferably of a suitable dielectric material such as plastic. The main body section 30 supports and secures a pair of buss-bars 32 at precise locations on either side. As is seen in FIG. 8, the buss bars 32 each include a primary structure, preferably a primary tab 34, for engaging a respective receptacle structure on the plug connector 12. The buss-bars 32 each also include a respective plurality of secondary structures, preferably secondary tabs 36, for engaging with respective connector member receptacles, connected to the signal outputs, as will be explained in detail below.

Figure 7A:
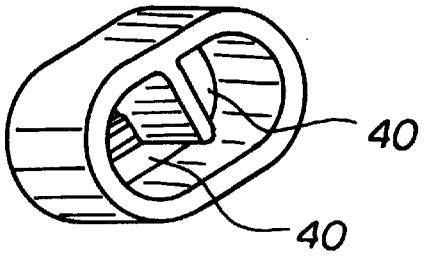
FIGS. 7A and 7B are respective frontal and reverse views of the main body section of the present secondary lock/bussing assembly.
Figure 7B:
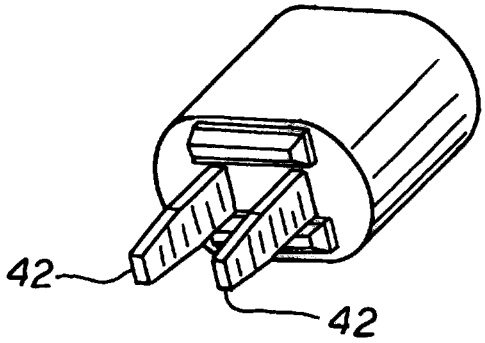

The buss-bars 32 are preferably stamped from tin-plated brass, and may optionally include a gold-plated contact area. The buss-bars 32 are preferably identical in shape. The entire 4-way secondary lock/bussing assembly is preferably held together by heat-stacking the maina body 30 with the two buss-bars 32. The primary tab 34 of each buss-bar 32 is bent so as to displace its plane from the plane of the secondary tabs 36. This displacement is substantially half the thickness of the main body section 30, so that when the bussing assembly 14 is assembled, the primary tabs 34 lie substantially within the same plane, along the middle of the main body section 30. As shown particularly in FIGS. 7A and 7B, the main body section includes channels 40 that receive the best section of the primary tabs 34, and help electrically isolate these portions. The main body section 30 also includes a pair of elongated sections 42 which electronically isolate the secondary tabs 36, and also help guide the connector member receptacles.

Figure 9A:
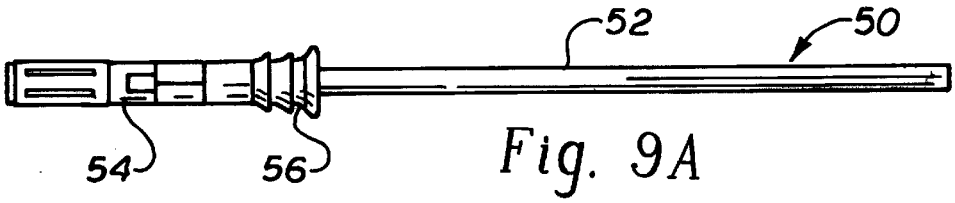
FIGS. 9A, 9B and 9C are respective top, side and oblique views of a wire assembly of a type used with the invention.
Figure 9B:
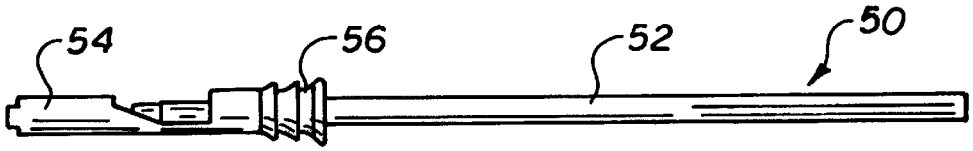
Figure 9C:
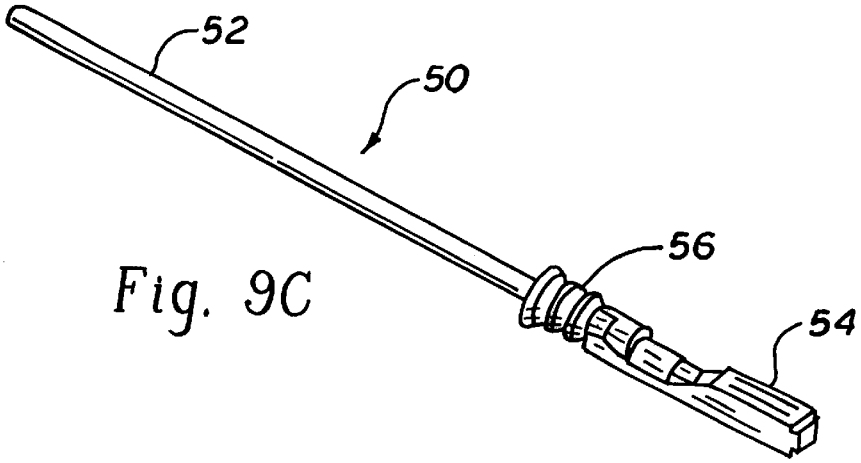

FIGS. 9A, 9B and 9C illustrate a wire assembly 50 used for the plurality of signal outputs. The wire assembly 50 is generally comprised of a wire 52, a female terminal or connector member receptacle 54 and a wire seal 56. In the preferred embodiment, four wire assemblies 50 are used, and the respective connector member receptacles 54 are inserted into one of the four barrels 18. As the 4-way secondary lock/bussing assembly 14 is received in the open end 20, the receptacles 54 are brought into engagement with a respective secondary tab 36. When assembled, the design of the 4-way primary/lock connector body 16 locks the wire assembly 50, preventing it from pulling out, and the 4-way secondary lock/bussing assembly locks the terminals inside the cavity of the connector body 16.

Figure 10A:
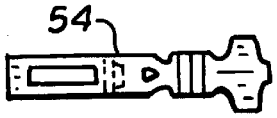
FIGS. 10A, 10B and 10C are respective top, side and frontal views of a receptacle used with the wire assembly of FIGS. 9A, 9B and 9C.
Figure 10B:
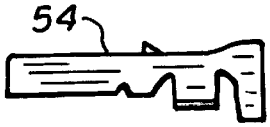
Figure 10C:
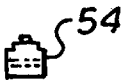
Figure 11:
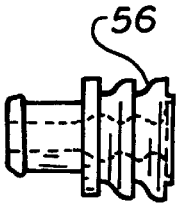
FIG. 11 is a side sectional view of a wire seal used with the wire assembly of FIGS. 9A, and 9C.

FIGS. 10A, 10B and 10C show the receptacle 54, which is a substantially hollow member formed to receive and enclose a secondary tab 36. The wire seal 56 surrounds the wire 52 and fits within a barrel 18, to provide a secure, watertight seal. These components are also readily available standard products, and are preferably from the Superseal 1.5 series sold by AMP Incorporated of Harrisburg, Pa.

The 2-way plug connector 12 contains two electrical wire connections. One is CAN-H and one is CAN-L. CAN-H and CAN-L are equivalent to a positive signal and a negative signal. CAN-H is connected through a buss-bar 32 to two wire assemblies 50 of the 4-way end (i.e., barrel end) of the 4-way connector body. Similarly, CAN-L is connected through the second buss-bar 32 to the other two wire assemblies 50 of the 4-way end (i.e., barrel end) of the 4-way connector body 16. As indicated in FIG. 3B, a first pair 60 of CAN-H and CAN-L cables continue on the data-bus. The second pair 62 of CAN-H and CAN-L cables is connected to the intended electronic unit. It should be appreciated that an optional drain wire may be routed along the exterior surface of the 4-way connector body.

The 4-way secondary lock/bussing assembly 14 of the present invention optionally includes one or more resistors.

Figure 1:
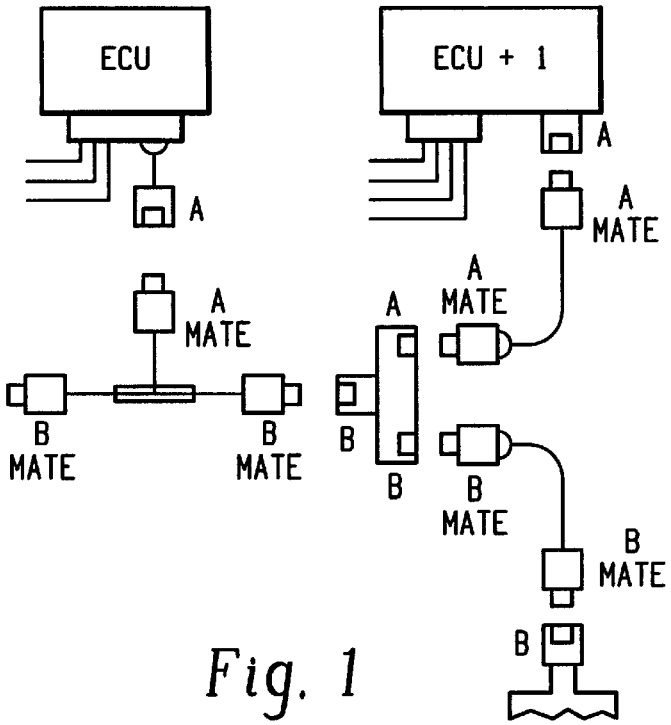
FIG. 1 shows an example of a J1939 network having a T-connection system.
Figure 2A:
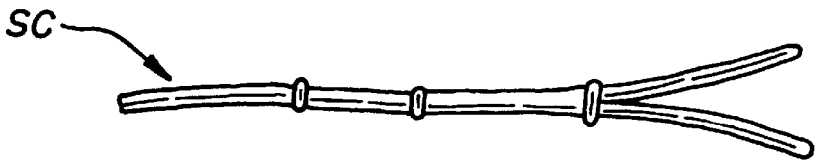
FIG. 2 shows an example of a splice connection and T-connector for a J1939 network.
Figure 2B:
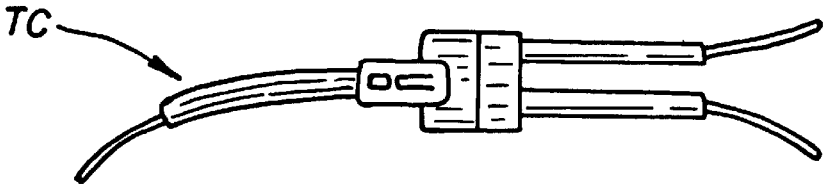

In this regard, two 240-Ohm resistors 38 may be connected to CAN-H and CAN-L buss-bars on the 4-way end. Two 240-Ohm resistors 38 in parallel are equivalent to one 120-Ohm resistance, but with a larger wattage power dissipation than one single resistor. This invention allows either two 240-ohm resistors or a single 120-ohm resistor to be used. The resistors 38 are added as an option for the connection at the ends of the CAN-bus. At the bottom right side of FIG. 1, there are shown B-Mate, cable, B-Mate, B and R-resistance components. These components are used to form a so-called "termination resistance" for the CAN-bus at both ends of the network. The present invention includes a built-in resistance feature, which eliminates the need for three connectors B-Mate, B-Mate, B and a cable. By utilizing the CAN-bus splice connector of the present invention, there is enormous savings in installing any network with the need of end-terminations. It also provides high reliability for the system.

The invention has been described with reference to a preferred embodiment. Obviously, modifications and alterations will occur to others upon a reading and understanding of this specification. It is intended that all such modifications and alterations be included.

We claim:

1. An electrical connector having at least one signal input, and including a respective plurality of signal outputs, comprising:

a connector body for engaging a plug connector at the at least one signal input;

a bussing assembly, received and retained within the connector body, and wherein the bussing assembly further comprises:

only one pair of buss-bars, electronically engagable with the plug connector for splicing the at least one signal input into the respective plurality of signal outputs, wherein each one buss-bar has only one respective primary tab for engaging a respective plug connector receptacle, and a respective plurality of secondary tabs for connecting to respective signal output structures, wherein each buss-bar is formed so that the plane of the primary tab is displaced from the plane of the second tabs such that in the bussing assembly the pair of primary tabs lie substantially within the same plane, for engagement with respective plug connector receptacles; and a main body section for supporting and securing the pair of buss-bars within the connector body.

2. The electrical connector of claim 1 wherein the respective signal output structures comprise respective connector member receptacles.

3. The electrical connector of claim 2 wherein the connector member receptacles are connected to respective signal-carrying wires to form respective wire assemblies.

4. The electrical connector of claim 1 wherein at least one buss-bar is stamped from tin-plated brass.

5. The electrical connector of claim 4 wherein at least one buss-bar includes a gold-plated contact area.

6. The electrical connector of claim 1 wherein the main body section is formed of plastic, and supports the at least a pair of buss-bars by one of heat stacking and holding.

7. The electrical connector of claim 1 wherein the connector body includes at least one mechanical locking feature for mechanically engaging a respective locking feature on the plug connector.

8. The electrical connector of claim 1 wherein the connector body includes an open end for receiving the plug connector.

9. The electrical connector of claim 1 wherein the signal output structures comprise respective wire assemblies and wherein the connector body includes a respective number of barrels for retaining the wire assemblies.

10. The electrical connector of claim 9 wherein the wire assemblies include respective wire seals for sealing inside the barrels.

11. The electrical connector of claim 1 wherein the main body section includes channels that receive and electrically isolate portions of the primary tabs.

12. The electrical connector of claim 1 wherein the main body section includes a plurality of elongated sections that electronically isolate the secondary tabs and also guide the connector member receptacles.

13. The electrical connector of claim 1 wherein the at least a pair of buss-bars receive two respective signal inputs corresponding to CAN-H and CAN-L signal pathways, and wherein the respective plurality of signal outputs correspond to first and second CAN-H and CAN-L signals, for use in a multiplexed data-carrying system.

14. The electrical connector of claim 13 wherein one of the first and second CAN-H and CAN-L signals connects to an electronic control unit, and the respective other connects to a data bus.

15. The electrical connector of claim 13 wherein the bussing assembly includes a resistance connecting the CAN-H and CAN-L signal pathways.

16. The electrical connector of claim 15 wherein the resistance comprises two 240 Ohm resistors connected in parallel, to provide effective power dissipation.

* * * * *